US007398729B2

(12) United States Patent
Eggert

(10) Patent No.: US 7,398,729 B2
(45) Date of Patent: Jul. 15, 2008

(54) COMPACTING PRESS FOR BULK MATERIALS

(75) Inventor: Axel Eggert, Monheim (DE)

(73) Assignee: Alexanderwerk AG, Remscheid (DE)

( * ) Notice: Subject to any disclaimer, the term of this patent is extended or adjusted under 35 U.S.C. 154(b) by 0 days.

(21) Appl. No.: 10/506,726

(22) PCT Filed: Mar. 5, 2003

(86) PCT No.: PCT/EP03/02212

§ 371 (c)(1),
(2), (4) Date: Feb. 25, 2005

(87) PCT Pub. No.: WO03/076172

PCT Pub. Date: Sep. 18, 2003

(65) Prior Publication Data

US 2005/0139095 A1 Jun. 30, 2005

(30) Foreign Application Priority Data

Mar. 8, 2002 (DE) ..... 102 10 307

(51) Int. Cl.
*B30B 3/04* (2006.01)

(52) U.S. Cl. ..... 100/176; 100/169; 100/172; 100/175

(58) Field of Classification Search ..... 100/155 R, 100/157, 158 R, 160, 162 R, 164, 163 R, 100/163 A, 168, 162 B, 169, 170, 171, 172, 100/175, 176, 327, 907; 72/237, 249; 425/363, 425/365, 366, 367, 409; 162/272, 358.1; 156/555; 241/235, 285.3
See application file for complete search history.

(56) References Cited

U.S. PATENT DOCUMENTS 3,484,326 A * 12/1969 Attilio ..... 156/582

(Continued)

FOREIGN PATENT DOCUMENTS

DE 37 31 934 A1 4/1989

(Continued)

OTHER PUBLICATIONS

Ricardo Fuentes, "A Static "Quasi Electric Shaft" for n Similar Rotor Winding Induction Motors", 2000 IEEE publication.*

*Primary Examiner*—Jimmy T. Nguyen
(74) *Attorney, Agent, or Firm*—Proskauer Rose LLP

(57) ABSTRACT

A compacting press for powdery to granular bulk materials, comprising two counterrotating rollers (1,2), arranged in one plane, which rollers (1,2) are held in a roller housing (11). At least one of the two rollers (1,2), preferably the top roller (1), is a loose roller which is flexibly supported by force generators (16,17). Each roller (1,2) at each of its two sides (1*a*, 1*b*, 2*a*, 2*b*) comprises its own electric motor drives (18*a*, 18*b*, 19*a*, 19*b*, 21*a*, 21*b*, 22*a*, 22*b*). The loose roller (1) bears these drives (21*a*, 21*b*, 22*a*, 22*b*). For easy installation and deinstallation, the roller housing (11) with a vertical design comprises two separate parts (11*a*, 11*b*), namely a bottom part (11*b*) comprising one roller (2) and a top part (11*a*) with the loose roller (1), wherein said top part (11*a*) is held by a swivel bearing (13) to the bottom part (11*b*) and is lockable. In this arrangement, the top part (11*a*) can be swiveled open by way of the swivel bearing (13).

1 Claim, 3 Drawing Sheets

U.S. PATENT DOCUMENTS

| | | | | | |
|---|---|---|---|---|---|
| 3,845,708 | A | | 11/1974 | Leibert | |
| 3,899,965 | A | | 8/1975 | Koch et al. | |
| 4,471,690 | A | * | 9/1984 | Yamaguchi et al. | 100/162 R |
| 4,676,862 | A | | 6/1987 | Kuehnert | |
| 4,905,910 | A | | 3/1990 | Wuestner | |
| 5,399,242 | A | * | 3/1995 | Schiel | 162/272 |
| 5,744,006 | A | * | 4/1998 | Mausser et al. | 162/358.1 |

FOREIGN PATENT DOCUMENTS

| | | | |
|---|---|---|---|
| DE | 4141754 | | 6/1993 |
| DE | 100 18 271 | A1 | 10/2001 |
| EP | 1147815 | | 10/2001 |
| RU | 2111805 | | 5/1998 |
| SU | 337173 | | 5/1972 |
| SU | 955478 | | 8/1982 |

* cited by examiner

COMPACTING PRESS FOR BULK MATERIALS

BACKGROUND OF THE INVENTION

The invention relates to a compacting press for powdery to granular bulk materials, comprising two counterrotating rollers, arranged in one plane, wherein said rollers are held in a roller housing by bearing blocks, with at least one of said rollers being a loose roller which is flexibly supported by force generators, with said rollers at each of their two sides comprising their own electric motor drives, wherein the drives of the loose roller are borne by said loose roller.

Compacting presses of this type are known (DE 37 31 934 A1). In these compacting presses, as a rule, bulk material is fed into the roller slit from a filling funnel by way of feed screws, which in the bulk material already build up a certain pressure. The rollers are driven by an electric motor from one side by way of a reducing power dividing gear. Since distribution of the bulk material fed into the roller slit is not even across the width of the roller, yet an essentially constant pressing force is desired across the width of the rollers, at least one roller is designed as a loose roller and is flexibly supported by force generators in a flexible manner. In the specified geometric shape this leads to a reduction in the torque load at the drive shafts of the rollers, and/or makes it possible to achieve better drive performance, or in the case of a specified throughput performance makes it possible to achieve smaller and thus more economical machines. Since the loose roller comprises its own drive on each of its two sides, said roller can move freely without the need of a power dividing gear, as would otherwise be usual in the case of stationary drives, which power dividing gear is commonly connected to the sides of the rollers by way of universally jointed shafts, with said power dividing gear being of elaborate construction and requiring considerable maintenance expenditure. Furthermore, because of the drives arranged on the sides of the rollers, there is no one-sided and thus uneven load being exerted on the rollers, so that an even pressing force across the width of the roller is ensured.

SUMMARY OF THE INVENTION

It is thus the object of the invention to provide a compacting press for bulk materials of the type mentioned in the introduction, whose installation and deinstallation requires little effort.

This object is met by a compacting press of the type mentioned in the introduction, in which the roller housing with a vertical design comprises two separate parts, namely a bottom part comprising one roller and a top part with the loose roller, wherein said top part is held by a swivel bearing to the bottom part and is lockable, wherein the top part can be swivelled open by way of the swivel bearing.

The compacting press according to the invention is very economical to manufacture because conventional components are used for the drive rather than expensive special gear arrangements with elaborate universal-joint shafts having to be used.

Since the drive emanates from both sides of the roller, the drives themselves can be comparatively small. This again results in cost advantages when compared to drives arranged on one side, which drives are correspondingly larger. Since at least the drives of the loose roller are borne by the loose roller, a constant load results during operation, irrespective of the position of the loose roller. This means that in operation, the pressing force across the roller width does not depend on the drives and the roller position. Instead, the pressing force only depends on the force generators. Since at least the loose roller bears its own drives, the prerequisites for easy installation are met, because, after the top part has been swivelled open, the rollers with their electromotor drives can be deinstalled from the top.

Another solution is known (DE 100 18 271 A1) in order to be able to install and deinstall the rollers and their bearing blocks in a two-roller compacting press, which rollers do not have individual drives. In this solution the roller housing is vertically divided into two frames which with two axes on the faces of the rollers, which axes are perpendicular to the roller axes, can be swivelled away from the faces of the rollers, so that the rollers with their bearing blocks can easily be taken upwards out of the roller housing.

It is understood that in the compacting press according to the invention the two rollers have to be driven at the same torque at the roller slit, and as a rule also at the same circumferential speed. When compared to the situation in a power dividing gear, in the case of individual drives this can be realised significantly more easily and economically in that the electric motors of the drives of each roller are interconnected by way of an electrical shaft. This can be implemented either in relation to each roller or in relation to the drives of the rollers among themselves.

BRIEF DESCRIPTION OF THE DRAWINGS

Below, the invention is described in more detail with reference to a drawing which shows one embodiment, as follows.

DETAILED DESCRIPTION OF THE INVENTION

Figure 1:
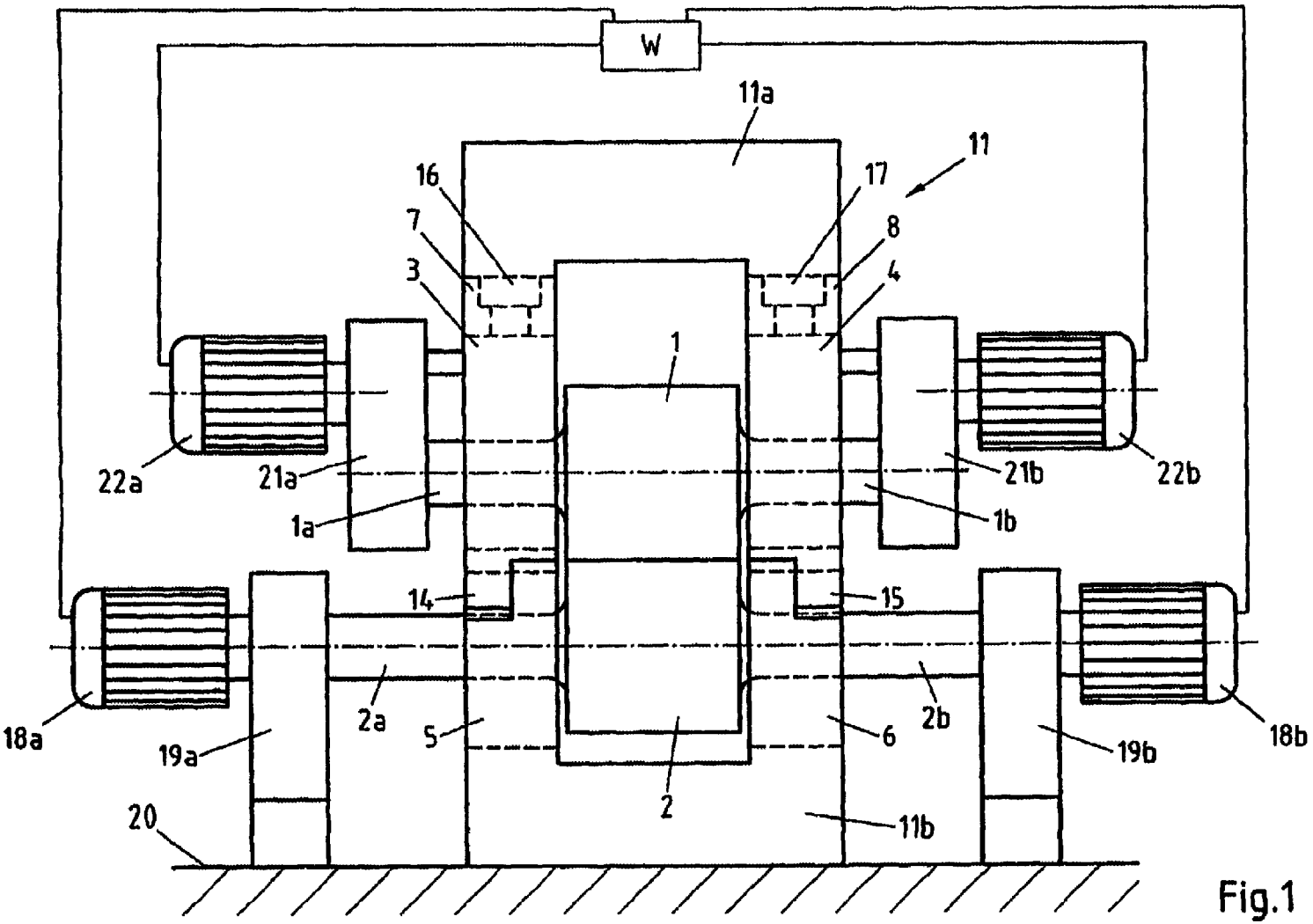
FIG. 1 a front view of a compacting press.
Figure 2:
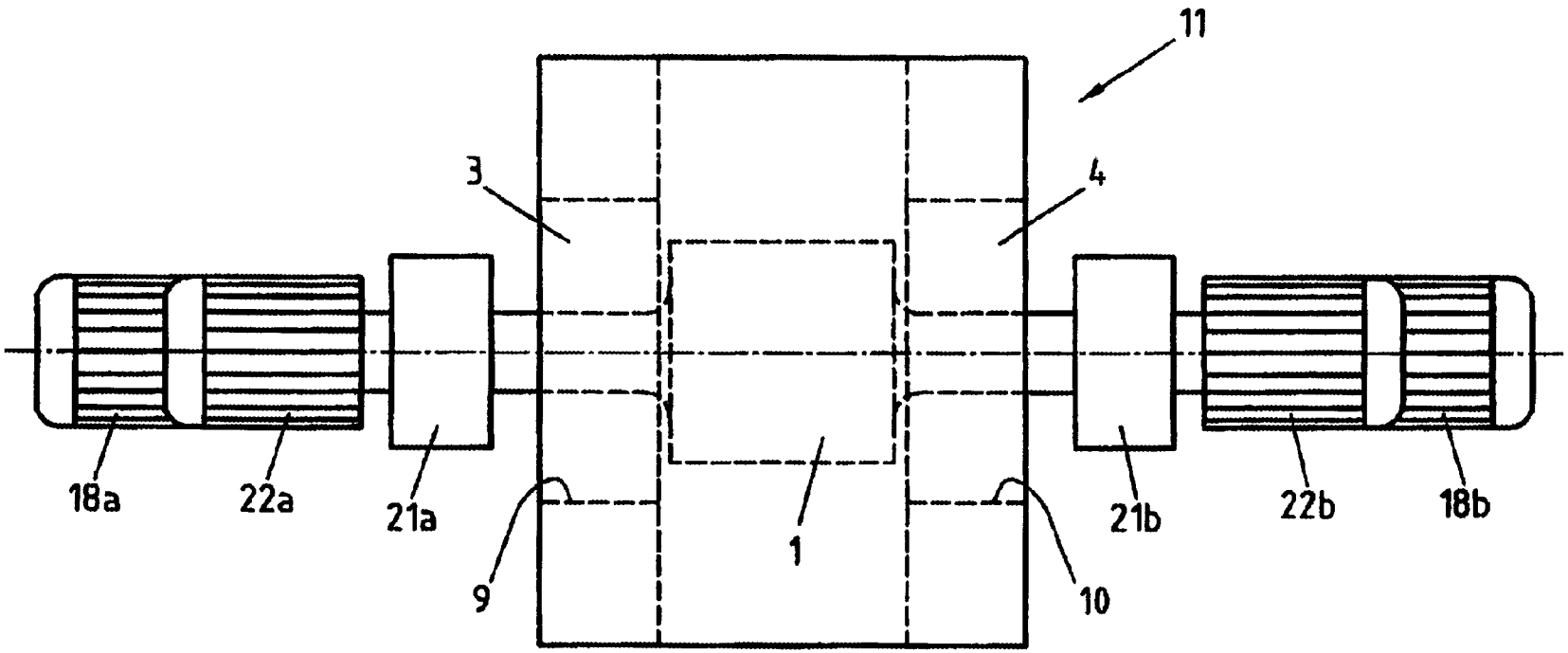
FIG. 2 a top view of the compacting press according to FIG. 1.
Figure 3:
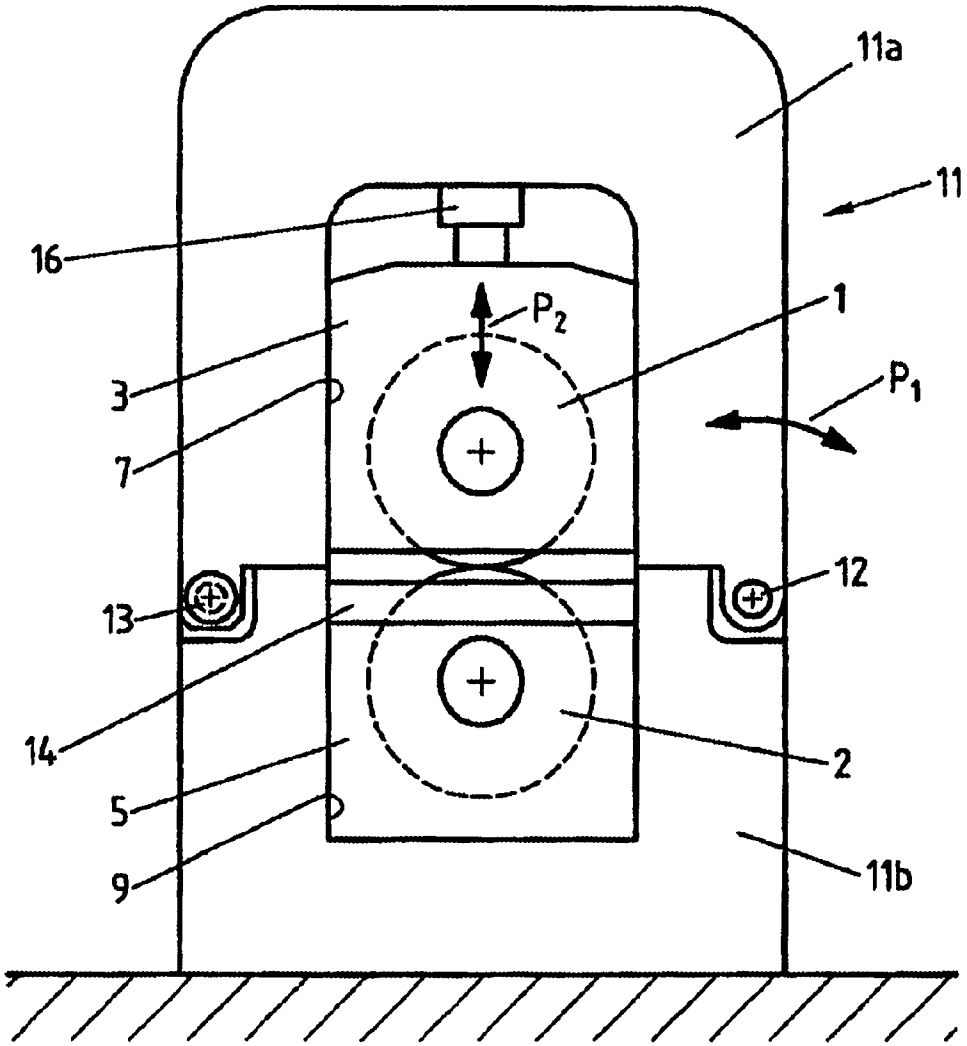
FIG. 3 a lateral view of the compacting press according to FIG. 1.

The compacting press, shown in the drawing, for powdery to granular bulk materials comprises two rollers 1, 2 of identical format, arranged vertically one on top of the other, wherein said rollers 1, 2 are held in corresponding windows 7, 8, 9, 10 of a two-part roller housing 11 by means of bearing blocks 3, 4, 5, 6 designed as chocks. The top part 11*a* of the roller housing 11 is held, so as to be able to be swivelled open in the direction of the double arrow $P_1$, at the bottom part 11*b* of said roller housing 11 by way of a swivel bearing 12. Said top part 11*a* can be locked by means of a locking bolt 13 for press operation.

The bottom roller 2 with its bearing blocks (chocks) 5, 6 is held as a fixed roller in the associated windows 9, 10 of the bottom part 11*b* of the roller housing 11. In this arrangement, the bearing blocks 5, 6 are held by detachable chocks 14, 15. The bearing blocks 3, 4 (chocks) of the top roller 1 are supported by force generators 16, 17 which are designed as a hydraulic cylinder-piston arrangement so that the top roller in vertical direction, as indicated by double arrow $P_2$, is movable and is thus a loose roller. By the force generators 16, 17 acting on the top roller on both sides, it becomes possible to adjust the roller slit.

On their two sides, both rollers 1, 2 are connected to electric motor drives. Thus, the bottom roller 2 with its two shaft ends 2*a*, 2*b* is connected to electric motors 18*a*, 18*b* by way of reducing gears 19*a*, 19*b*. The reducing gears 19*a*, 19*b* independently stand on a base plate 20 on which the roller housing 11 also stands.

The top roller 1, i.e. the loose roller, at its shaft ends 1*a*, 1*b* comprises reducing gears 21*a*, 21*b*, and electric motors 22*a*, 22*b* coupled to them. The required torque support of these electric motor drives 21*a*, 22*a*, 21*b*, 22*b* is by way of the bearing blocks (chocks) 3, 4 guided in the windows 7, 8.

In order to drive the rollers 1, 2 with the same torque on both sides, they are interconnected by way of an electrical shaft W, as diagrammatically indicated in FIG. 1.

Deinstallation and installation of the rollers 1, 2 is extremely easy. After the locking bolt 13 has been undone, the top 11*a* can be swivelled open. After the force generators 16, 17 have been disconnected, the top roller 1 can be deinstalled together with its electromotor drives 21*a*, 22*a*, 21*b*, 22*b*, while the bottom roller 2 can only be removed upwards after the inserts 14, 15 have been undone and after having been disconnected from its stationery electromotor drives 18*a*, 19*a*, 18*b*, 19*b*, unless their stationary installation arrangement on the base plate 20 is deinstalled.

The invention claimed is:

1. A compacting press for powdery to granular bulk materials, comprising:

a roller housing;

two counterrotating rollers arranged in one plane, said rollers are held in said roller housing;

a plurality of bearing blocks positioned within said roller housing for supporting said rollers, said bearing blocks of one of said rollers are held by detachable chocks, at least one of said rollers being a loose roller which is flexibly supported by force generators, said force generators are positioned above said bearing blocks;

a plurality of electric motor drives and electric motors, each of opposing ends of each of said rollers is connected to the respective electric motor drives and the respective electric motors, wherein all of the electric motors of the drives of each of said rollers are interconnected to each other by an electrical shaft so that the rollers rotate at the same speed, wherein the drives of the loose roller are borne by said loose roller;

wherein the roller housing is arranged vertically, the roller housing comprises two separate parts, a bottom part of the two separate parts having one of said rollers and two of the bearing blocks connected thereto and a top part of the two separate parts having the loose roller and the other two of the bearing blocks connected thereto, one side of said top part is held by a swivel bearing to the bottom part and the other side of said top part is lockable to the bottom part by a locking element, wherein the top part is swiveled open by way of the swivel bearing.

* * * * *